United States Patent [19]

Torres et al.

[11] Patent Number: 4,938,109

[45] Date of Patent: Jul. 3, 1990

[54] TORQUE HOLD SYSTEM AND METHOD

[75] Inventors: Carlos A. Torres, 2131 Peach Ridge Rd., Brookshire, Tex. 77423; Wesley L. Leggett; Jay K. Thomas, both of Houston, Tex.

[73] Assignee: Carlos A. Torres, Brookshire, Tex.

[21] Appl. No.: 335,847

[22] Filed: Apr. 10, 1989

[51] Int. Cl.[5] ..... B25B 23/14

[52] U.S. Cl. ..... 81/467; 173/12

[58] Field of Search ..... 81/467, 57.24, 57.33, 81/57.35, 57.40, 57.15; 173/12

[56] References Cited

U.S. PATENT DOCUMENTS

| | | | |
|---|---|---|---|
| 4,679,469 | 7/1987 | Coyle | 173/12 X |
| 4,700,787 | 10/1987 | Buck et al. | 173/12 X |
| 4,730,254 | 3/1988 | Voden | 81/467 X |

*Primary Examiner*—James G. Smith

*Attorney, Agent, or Firm*—Carlos A. Torres

[57] ABSTRACT

Hydraulic tongs, used to screw oilfield tubulars together, are equipped with torque control means which enable the tongs to rotate the tubulars and then gradually apply torque until a preselected torque value is reached, hold the torque at this value a desired period of time and then release the torque. In one form of the invention, a tong control restricts the power of the tong motor to enable low torque rotation while limiting the maximum torque which can be produced by the tong motor. A hydraulic cylinder placed in the tongs' restraining line is controlled to shorten, hold or extend the line. When the line is shortened, the tongs are pulled in a direction which increases the torque to a value above the maximum torque produced by the tong motor. The system allows heavy, powerful tongs to be used to accurately apply and hold a wide variety of selected torque values.

17 Claims, 2 Drawing Sheets

FIG. 3
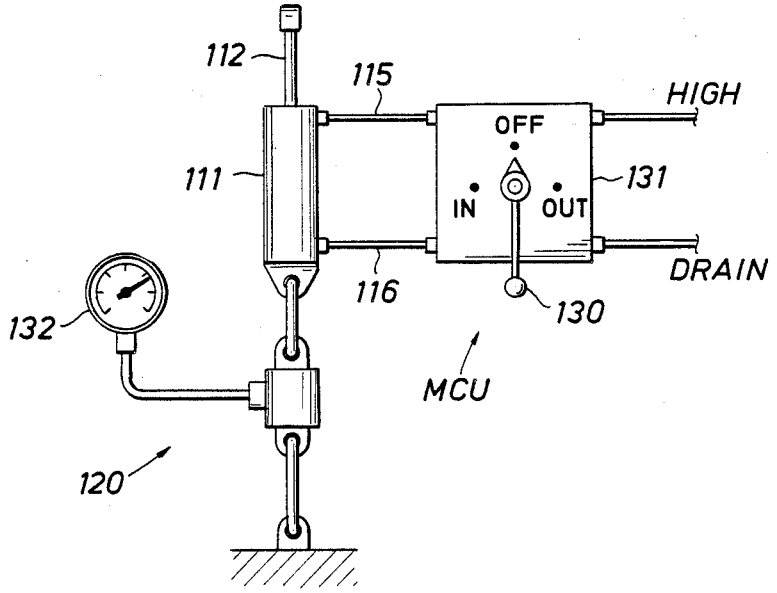
FIG. 4
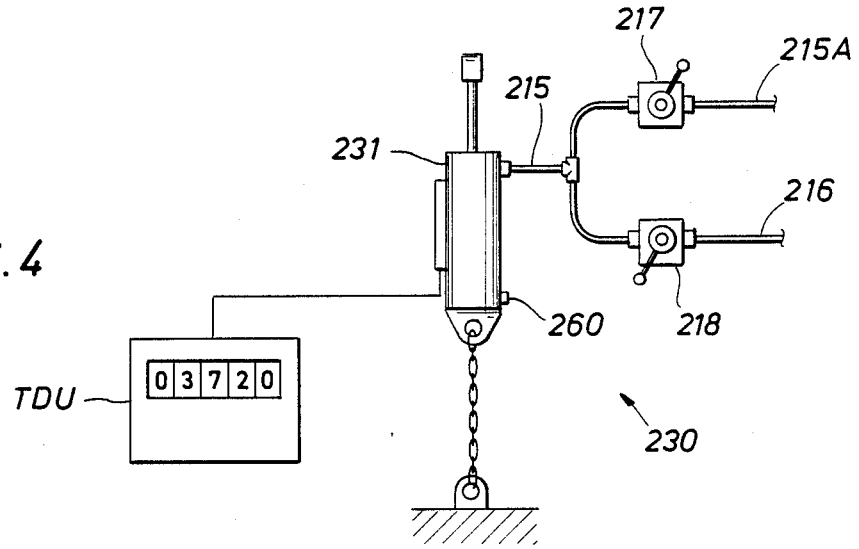
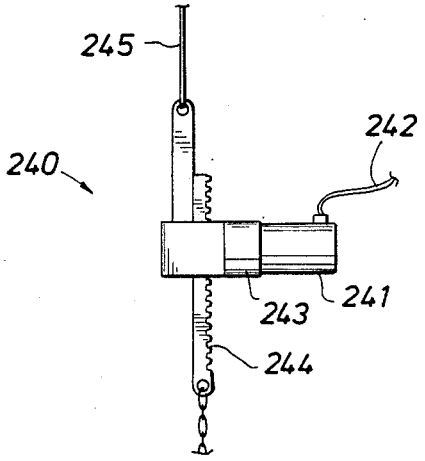
FIG. 5

TORQUE HOLD SYSTEM AND METHOD

BACKGROUND OF THE INVENTION

1. Field of the Invention

This invention relates generally to equipment and techniques for applying rotary motion and torque to objects. In a specific application, the invention relates to the use of hydraulically powered wrenches for screwing two threaded oilfield tubulars to each other and applying and then holding a precise torque on the screwed together connection.

2. Brief Description of the Prior Art

Oilfield tubulars such as casing and tubing are typically thirty to forty feet in length and have threaded connections at their ends. The pipe sections, or "joints", are usually screwed together with hydraulically powered wrenches, referred to as "power tongs", to form a long pipe string. The tongs are used on a drilling or completion rig to add the joints to a pipe string which is lowered into the well. Pipe strings are used to case the well, bring well fluids to the surface, control the well and in some cases to drill or workover the well. Power tongs are also used in pipe threading facilities and pipe yards to "buckon" or screw on couplings to the threaded ends of pipe joints.

This invention is concerned in part with the screwing together or "makeup" of threaded connections which employ internal shoulders or metal-to-metal sealing surfaces which limit relative rotation between mating connections after the shoulders or surfaces engage. The two threaded pieces may be screwed together with relatively low torque until the shoulders or seals in the connection engage. Continued effort to turn the pipe after shouldering causes the torque applied to the connection to increase very rapidly with only a small amount of additional rotation.

One benefit of these connections is that they allow the string to be rotated in the well without continued screwing together of the pipe segments. Application of high torque to the connections can also preload the seals so that they remain tightly engaged when the string is hung in tension. Hoop and compressive stresses in the connection are also significantly less than those present in conventional, tapered, interference connections.

Torque must be precisely applied to these special connections for proper makeups. This can be difficult to achieve with conventional tongs because the torque climbs so rapidly after shoulders or seals in the connections engage. The tongs may be controlled to prevent over torquing with a system which automatically bypasses or "dumps" the hydraulic power fluid around the tong motor when a desired minimum torque level is sensed. However, the response time in these dump systems is relatively slow compared to the rise time of the torque applied to the connection. The result can be poor control over the final torque applied to the connection.

Another problem with most dump systems is that a very quick, sharp spike or pulse of torque which reaches the minimum torque level even instantaneously may cause the system to dump even though the connection may not have had sufficient time to respond to the torque.

Controlling conventional tongs by adding means to closely control the fluid pressure or the fluid flow through the tong motor produces only limited improvement. Even if a particular combination of hydraulic power source and tongs may be adjusted so that fairly consistant results are obtained, the control is lost if the temperature or viscosity of the hydraulic fluid change or if a tong or power source is replaced. As a further problem, the output power from the tong motor is nonlinear and if the tong motor is at the peak of its power cycle when shouldering occurs, the torque output of the tongs is greater than at some intermediate point of its power cycle. The power cycle position of the motor at the shouldering point cannot practically be controlled from one makeup to the next. The problem is compounded when it is desired to reach and then hold a selected torque value. The control mechanisms which are designed to dump torque at a desired value are not designed to hold or keep the torque constant at the desired value.

Prior art attempts to correct these problems include systems which use specially designed control mechanisms built into the tongs to enable a slow, controlled application of torque. With such equipment, the torque values may be held above a selected minimum torque value for a sufficient time to ensure full application of torque to the connection. When this approach is taken, control is limited by the particular drive and power mechanism used in the tongs and appropriately modified tongs are required for every different range of pipe sizes. Moreover, the cost of modifying existing conventional tongs and the number of modified tongs required to cover the entire range of pipe sizes renders the prior art approach relatively expensive. Additionally, since the control mechanism is an integral part of the tongs, it is necessary to transport the tongs to the job site rather than use tongs which might already be at the site. This can cause delay and additional transportation expense.

Another problem associated with prior art power tongs is their inability to accurately apply very low torques required for some connections. For example, some fiberglass connections require makeup torques as low as 100 foot-pounds or less. Most small tubing tongs are designed to apply torques in the range of 1,000 to 7,000 foot-pounds. Because of the size and weight of the tongs and because of characteristics of their power supplies and motors, accuracy in applying very low torque values is difficult if not impossible. The problem is present at these low torques for both shouldering connections and conventional interference connections which have no internal shoulders.

SUMMARY OF THE INVENTION

In one form of the invention, control means on hydraulic power tongs restricts the maximum power of the tong motor so that the tongs may rotate the pipe sufficiently to complete the major rotational requirement of the makeup but can apply only a limited torque force to the connection. The limited torque force is set well below the final torque desired to be applied to the pipe. After the major rotation of the connection is completed, a hydraulic cylinder in the tongs' restraining line is actuated to shorten, hold, or extend the line to increase, hold or reduce the torque applied through the tongs. The system enables the tongs to first screw the pipe together and then exert and hold a very precise torque on the connection.

A primary object of the present invention is to provide a system which may be employed with conventional power tongs to accurately control the torque applied by the tongs.

It is also an object of the invention to enable conventional tongs to accurately apply and hold a selected torque.

Another object of the invention is to provide a portable control system which may be employed with a variety of conventional power tongs.

Another important object of the present invention is to provide a torque control system which does not rely on the pressure differential across the tong motor or the rate of fluid flow through the motor to reach the desired final torque applied to the pipe.

An object of the present invention is to use a powering means, in addition to the tong motor, to establish the desired torque output of the tongs.

In a preferred form of the invention, it is an object to use a single conventional hydraulic power source to power the tongs and also provide hydraulic power from the mechanism employed to obtain the precise torque control.

A specific object of the present invention is to provide a pulling means which may be inserted in the snubline of conventional tongs whereby fine control of the torque applied by the tongs may be obtained without modification of the tongs.

Still another object of the invention is to employ a conventional torque sensing means as the pulling means in the snubline of conventional hydraulic power tongs whereby close control of the torque output from the tongs may be achieved without the need for a separate control device.

These and other objects, features and advantages of the present invention will be more fully described in the following description, drawings and claims.

DESCRIPTION OF THE DRAWINGS

FIG. 3 is a partial schematic illustration of a manual control form of the system of the present invention.

FIG. 4 is a partial schematic illustration of another form of the invention which employs the torque sensing means to apply the additional control torque; and FIG. 5 illustrates an electrically powered mechanical pulling device which may be employed to provide torque control in the present invention.

DESCRIPTION OF THE INVENTION

Figure 1:
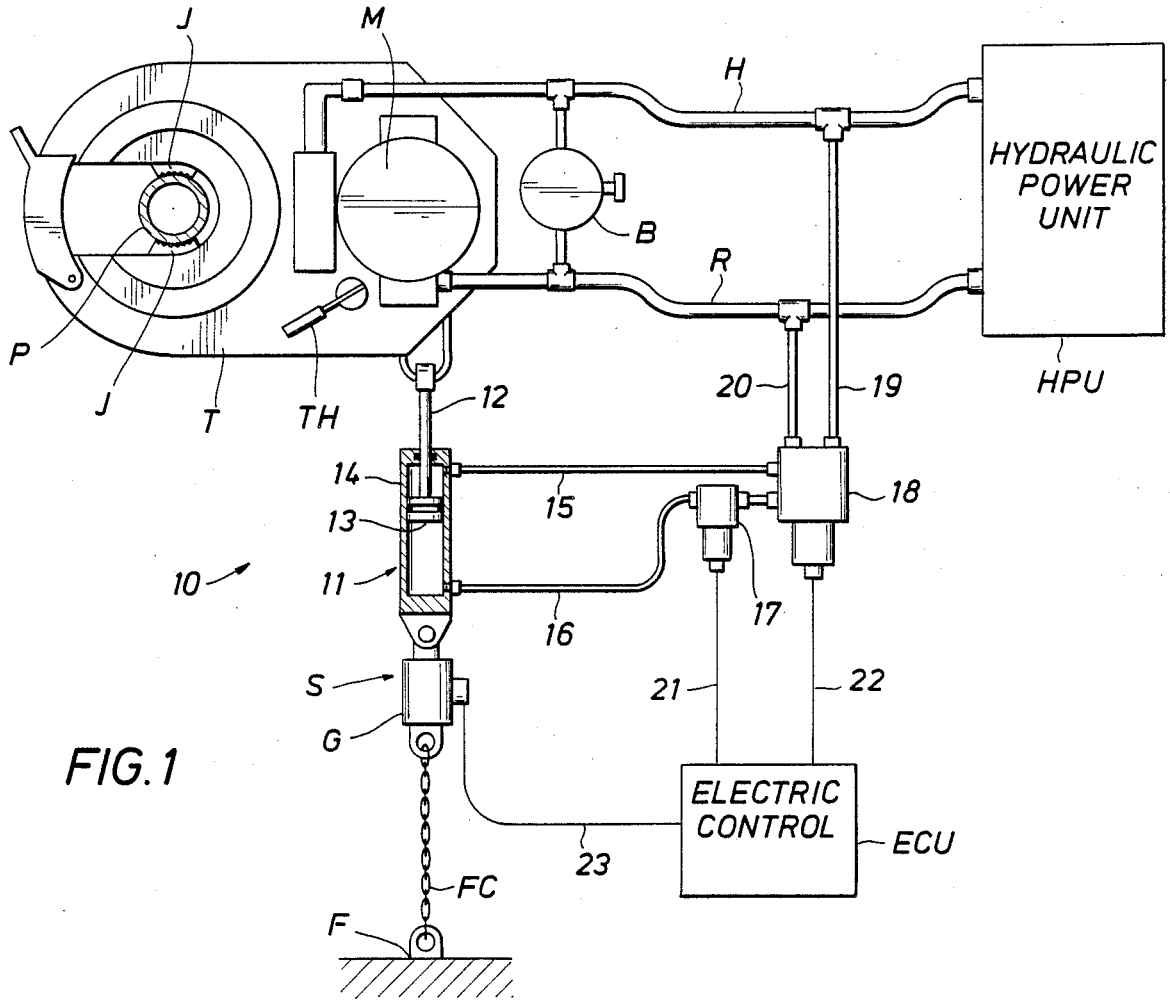
FIG. 1 is an overhead view, partially in section and partially schematic, illustrating an automatically operated form of the torque control system present invention.

One form of the present invention 10, illustrated in FIG. 1, is an electric-over-hydraulic control system. The system 10 employs a conventional set of hydraulic tongs T to rotate and apply torque to a pipe P through jaws J. The jaws J are actuated by the tong operator through a tong control handle TH to selectively grip or release the pipe and to regulate the speed of rotation and the amount of torque applied to the pipe. The mechanical power to move the jaws J is supplied by a first powering means comprising a hydraulic tong motor M driven by high pressure hydraulic fluid supplied through a hose H. The returning fluid is brought back to the tank of the unit HPU through a hose R.

A first control means, comprising a conventional regulator B connected across the tong motor M. may be adjusted to limit the effective pressure differential acting on the motor which in turn limits the force which may be exerted on the pipe P. Proper adjustment of the regulator allows the tong operator to apply full throttle through the handle TH without applying the full potential force of the tongs to the pipe P.

In the operation of the equipment as thus far described, the entire body of the tongs T attempts to rotate around the pipe P as torque is applied by the tongs. If the tongs are attempting to rotate the pipe P clockwise, as viewed in FIG. 1, the tong body attempts to rotate counter-clockwise. Such tong rotation is stopped by a restraining line, or "snubline" indicated generally as S, which extends between the tongs and a fixture F which is fixed relative to the pipe P. Typically, the fixture F is a derrick leg or metal post secured to the rig floor. The reaction force in the snubline S is measured by a conventional strain gage G connected to the fixture F by a flexible cable FC. The torque imparted to the pipe P is determined by multiplying the force measured by the gage G by the distance from the center line of the pipe P to the attachment point of the snubline S with the tongs T.

The system 10 as described thus far is conventional. As described previously, a problem is encountered in using such conventional systems in making up shouldering connections or in applying very low torque values to any type connection. In either case, the tongs lack the fine control necessary to consistantly apply and hold a specific torque.

In the makeup of shouldering connections, a tong operator cannot control the system manually through the throttle TH because the torque rises much too rapidly after the pipe connections shoulder. Since no significant rotation occurs after the connections shoulder, very large torque values are produced with very small movements of the throttle TH. As with the application of very low torque values, precise control in these situations is usually beyond the capability of either the tong operator or of the power tongs themselves.

In some situations, the regulator B may be adjusted to automatically limit the output of the tongs so that a desired torque value may be applied and held with the throttle TH fully open. However, this approach at control will vary from one connection to the next because of changes in hydraulic fluid temperature and viscosity. Even with constant fluid characteristics, the final torque varies from one connection to the next because the tong motor produces a non-linear output. The non-linear output results primarily because the power cycle position of the tong motor when the connection shoulders determines the amount of torque produced for a given pressure differential. Since this position varies from one makeup to the next, the final torque output by the tongs is not consistant.

The invention of the system 10 provides for second powering means comprising a mechanical pulling means 11 placed in the snubline S. The means 11 is a conventional double acting hydraulic cylinder having a rod 12 connected to a piston 13 which reciprocates within a cylinder 14. When the piston is moved in the direction of the fixture F, the snubline S is shortened causing the tongs T to rotate or attempt to rotate the pipe P. The cylinder means 11 produces a substantially linear power output in response to increasing hydraulic pressure. The result is a smooth, closely controlled application of torque to the pipe P.

Movement of the piston is effected by the application of pressurized hydraulic fluid to either the piston end or the rod end of the cylinder. A supply line 15 connects into the rod end chamber of the cylinder and a supply line 16 connects into the piston end chamber. A normally open, two way, solenoid operated valve 17 controls the flow of fluid through the line 16. The two lines 15 and 16 are connected to the hydraulic system through a two position, solenoid operated, four way valve 18. A supply line 19 provides high pressure fluid to the valve while a return line 20 connects the valve to the drain or tank side of the system.

A second control means comprising an electric control unit ECU operates the valves 17 and 18 via power signals sent over electric cables 21 and 22 respectively. An electric cable 23 supplies power and conveys force readings from the gage G to the unit ECU.

In operating the system 10 to makeup shouldering connections, the regulator B is adjusted to limit the tongs' output torque to a value V-1 which is below the desired torque V-0 to be applied to the pipe P. The pressure differential established by the regulator B must be high enough to provide sufficient tong power to rotate the pipe until the shoulders in the connection engage but insufficient to exceed the torque value V-0 at any position of the power cycle of the tong motor. The control unit ECU is programmed to begin application of high pressure fluid to the rod end of the cylinder 11 when the torque being applied to the pipe p exceeds a minimum actuation torque V-2, where V-2 is less than V-1 and more than zero. This is done by applying an electrical power signal to the solenoid 18 causing it to change position to allow the fluid in the piston end of the cylinder 11 to drain through the valve 18 to the line 20 while the high pressure fluid flows from line 19 through the valve 18 through the line 15 to the rod end of the cylinder. As the rod end of the cylinder chamber expands, the piston and attached rod 12 are forced to pull in causing the tongs T to exert additional torque on the pipe P. The mechanical advantage of the gear drive connecting the jaws J to the motor M and the nonlinear characteristic of the motor M are such that the added torque being generated by the pulling cylinder 11 will not overpower the force generated by the tong motor so that the tongs do not slip backward.

Figure 2:
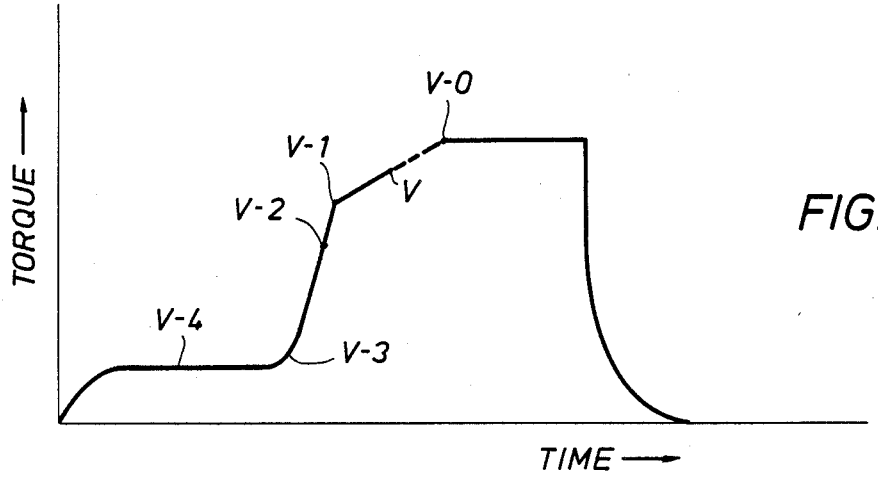
FIG. 2 is a graph of torque vs. time for a connection made up with the torque control system of the present invention.

FIG. 2 illustrates a typical graph of torque plotted as a function of time for the makeup of a conventional shouldering, noninterference thread connection. The torque is relatively low at a substantially constant value V-4 as the connection is initially screwed together. When the internal shoulders engage, at V-3, the torque begins to rise rapidly passing through the minimum actuation torque V-2 and rising to the torque value V-1, the maximum torque allowed by the setting of the regulator 8. The electronic control unit ECU senses when torque exceeds the value V-2 and actuates the pulling system 11 to begin moving the tong arm toward the fixture F. The torque on the pipe P increases gradually along the torque slope V to the torque value V-0 where the unit ECU controls the puller to hold the torque steady for a selected period of time. Torque is then released either by releasing the tong motor via the handle TH or extention of the puller 11.

In a typical sequence of operations, the jaws J of the tongs T are placed around the pipe P and the tong operator actuates the handle TH to cause the tong jaws J to grip and begin rotating the pipe P. When the torque value V-2 is detected by the unit ECU, a power signal is sent over the line 22 which changes the normal state of the valve 18. This permits high pressure fluid to flow through the line 15 causing the pulling unit 11 to pull the tongs T in a direction which increases the torque applied to the pipe P. When the torque measured by the gage G reaches the desired value V-0, a power signal is applied over the line 21 and the valve 17 closes. This stops the increase of torque. If the torque begins to fall, the control unit ECU repeatedly applies and then terminates a power signal to the line 17 as required to hold the torque steady. After a desired period of time, the control ECU deactivates the valves 17 and 18 allowing them to return to their normal operating position which reverses the flow of fluid through the valve. The result is that the high pressure fluid is fed to the piston side and the drain is connected to the rod side causing the piston and attached rod to move away from the fixture F. This produces an elongation of the cylinder 11 which relieves the torque acting on the pipe p and returns the cylinder to its normally extended condition. The tong operator releases the tongs from the pipe and the system is ready to repeat the described makeup sequence.

A manual system 120 for controlling the operation of the torque control system of the present invention is illustrated in FIG. 3. The system is similar to that described with reference to the system of FIG. 1 except that the electric control unit is replaced by a manual control unit MCU. Hydraulic lines 115 and 116 operate to supply fluid to the cylinder in the same manner as described earlier with reference to FIG. 1. In the system 120, after the tongs have reached the maximum torque permitted by the regulator B (FIG. 1), an operator manually moves the control handle 130 of a four way valve 131 to the "in" position. This allows high pressure hydraulic fluid to cause the cylinder 111 to pull the rod 112 and tongs in a direction which increases the torque applied to the pipe. The operator monitors a conventional dial indicator torque gage 132 until the desired torque V-0 is reached and then moves the valve to the "off" position to hold the torque. The valve may be selectively moved to "in" or "out" as required to hold the torque value steady. After the torque has been held a desired period of time, the operator moves the handle 130 to the "out" position causing the high pressure fluid and drain to reverse which extends the cylinder 111. This "dumps" or releases the torque and prepares the system for the next makeup.

A modified form of the invention 230 illustrated in FIG. 4 employs a conventional hydraulic load cell strain gage 231 to monitor torque as well as to provide the desired pulling motion for fine control of torque. A hydraulic line 215 conveys fluid to and from the rod side of the cylinder 231. An air port 260 vents the piston side of the cylinder 231 to the atmosphere. A solenoid operated valve 217 connects the line 215 with a high pressure supply line 215A while a similar valve 218 connects the line 215 to a drain line 216. The valves 217 and 218 are conventional, two way, normally closed, solenoid valves. A pressure transducer (not illustrated) communicating with the rod side chamber in the cylinder transmits information to a conventional torque display unit TDU which employs the information to calculate and display the torque being exerted by the tongs. The information may be in the form of hydraulic pressure, voltage or other variable which is related to the force being exerted on the gage 231.

High pressure fluid is supplied to the cylinder 231 when the valve 217 is energized causing the cylinder to pull the tongs in a direction to increase torque. When the desired torque is reached, the valve 217 is closed to hold the torque steady. After the makeup is complete, the valve 218 is opened to direct the fluid in the cylinder back to the drain. The initial torque imparted by the tongs during the next makeup stretches the cylinder 231 to its starting position. The valve 218 is closed and the described pulling sequence is repeated.

A mechanical puller 240 is illustrated in FIG. 5. The puller includes an electric motor 241 supplied with electrical power by an electrical line 242. The motor works a pinion gear (not illustrated) through a reduction gearing system 243 to move a rack 244 to extend or retract the snubline 245. As the puller 240 retracts or extends the snubline, the torque output of the tongs is increased or decreased. Suitable power signals over the line 242 are provided by any conventional power control system (not illustrated) to produce torque vs. time makeups of the type illustrated in FIG. 2.

While specific forms of the invention have been described, it will be appreciated that modifications may be made without departing from the spirit of the present invention. For example, with reference to FIG. 1, the function of the pressure regulator B, or first control means, may be provided by an internal regulator (not illustrated) found in conventional power tongs or power units. If desired, the first control means may be a mechanical stop (not illustrated) to limit the maximum movement of the tongs' throttle. These and other variations or modifications will be readily apparant to those having ordinary skill in the art.

We claim:

1. A powered mechanical wrench for rotating and applying torque forces to an object comprising:

(a) first powering means for rotating and exerting torque on said object;

(b) first control means for limiting the maximum torque exerted by said first powering means;

(c) second powering means including a power device separate from said first powering means for moving said wrench in a direction to increase the torque exerted on said object; and (d) second control means for controlling said second powering means for increasing the torque on said object to a selected value above the maximum torque exerted by said first powering means.

2. A powered mechanical wrench as defined in claim 1 wherein said second control means includes means for controlling said second powering means to hold said selected value of torque for a sustained period of time.

3. A powered mechanical wrench as defined in claim 1 wherein:

(a) said wrench comprises hydraulic power tongs;

(b) said first powering means is a hydraulic motor included as a part of said tongs; and (c) said first control means is a pressure regulator which limits the effective pressure differential acting across said hydraulic motor.

4. A powered mechanical wrench as defined in claim 1 wherein said second control means comprises an electric-over-hydraulic system for controlling the movement of said power device as a function of the torque being exerted on said object.

5. A powered mechanical wrench as defined in claim 3 wherein:

(a) said second powering means comprises a hydraulic cylinder; and (b) said second control means comprises an electric-over-hydraulic system for controlling the movement of said hydraulic cylinder as a function of the torque being exerted on said object.

6. A powered mechanical wrench as defined in claim 5 wherein:

(a) said object is a shouldering type threaded well tubular; and (b) said pressure regulator is set to allow said hydraulic motor to develop sufficient power to rotate said tubular until shoulders in mating connections engage while limiting the maximum power output from said motor to exert a torque less than the maximum torque desired to be exerted on said tubular.

7. A powered mechanical wrench as defined in claim 3 wherein:

(a) said second powering means comprises a hydraulic cylinder; and (b) said second control means comprises a manually operated valve for controlling movement of said hydraulic cylinder.

8. A powered mechanical wrench as defined in claim 3 wherein said second powering means comprises a combined hydraulic cylinder and torque transducer.

9. A powered mechanical wrench as defined in claim 3 wherein said second powering means comprises an electrically powered mechanical pulling means.

10. A powered mechanical wrench as defined in claim 2 wherein:

(a) said wrench comprises hydraulic power tongs;

(b) said first powering means is a hydraulic motor included as a part of said tongs; and (c) said first control means is a pressure regulator which limits the effective pressure differential acting across said hydraulic motor.

11. A powered mechanical wrench as defined in claim 2 wherein:

(a) said second powering means comprises a hydraulic cylinder; and (b) said second control means comprises an electric-over-hydraulic system for controlling the movement of said hydraulic cylinder as a function of the torque being exerted on said object.

12. A powered mechanical wrench as defined in claim 5 wherein said second control means includes means for controlling said second powering means to hold said selected value of torque for a sustained period of time.

13. A powered mechanical wrench as defined in claim 6 wherein said second control means includes means for controlling said second powering means to hold said selected value of torque for a sustained period of time.

14. A powered mechanical wrench as defined in claim 7 wherein said second control means includes means for controlling said second powering means to hold said selected value of torque for a sustained period of time.

15. A powered mechanical wrench as defined in claim 8 wherein said second control means includes means for controlling said second powering means to hold said selected value of torque for a sustained period of time.

16. A powered mechanical wrench as defined in claim 9 wherein said second control means includes means for controlling said second powering means to hold said selected value of torque for a sustained period of time.

17. In a tong means for gripping, rotating and imparting torque to a well pipe, said tong means having a tong body with a tong arm extending away from a gripping head, a restraining line connected to said tong arm, a tong motor mounted to the tong body and connected with the gripping head to provide rotary and torque inducing force to the well pipe, an adjustable regulator means operatively connected to said motor to limit the maximum power supplied from said motor to said gripping head, the improvement comprising a pulling means to pull the tong arm in a direction to increase the torque being applied through said gripping head and to hold said pulling means at a position which maintains the increased torque constant for a selected period of time.

* * * * *